US007299772B1

(12) United States Patent
Hardin

(10) Patent No.: US 7,299,772 B1
(45) Date of Patent: Nov. 27, 2007

(54) COOLING GALLERY FAN ASSEMBLY FOR A PISTON

(75) Inventor: William J. Hardin, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/472,755

(22) Filed: Jun. 22, 2006

(51) Int. Cl.
*F01P 1/02* (2006.01)
*F02F 3/16* (2006.01)
*F02F 3/20* (2006.01)

(52) U.S. Cl. ..... 123/41.35; 123/41.34; 123/193.1; 92/186

(58) Field of Classification Search ..... 123/41.35, 123/41.34, 193.6, 41.36, 41.39; 92/173, 92/186, 239; 82/174
See application file for complete search history.

(56) References Cited

U.S. PATENT DOCUMENTS 1,201,543 A * 1/1916 Becker ..... 417/430
2,523,699 A 6/1950 Holt et al.
2,967,516 A * 1/1961 Friedrich ..... 123/73 R
3,314,402 A * 4/1967 Dietrich ..... 123/41.35
4,175,502 A * 11/1979 Moebus ..... 123/41.35
4,581,983 A 4/1986 Moebus
4,587,932 A * 5/1986 Moebus ..... 123/41.35
4,608,947 A * 9/1986 Stadler ..... 123/41.39
6,532,913 B1 3/2003 Opris

* cited by examiner

*Primary Examiner*—Stephen K. Cronin
*Assistant Examiner*—Ka Chun Leung
(74) *Attorney, Agent, or Firm*—Finnegan, Henderson, Farabow, Garrett & Dunner

(57) ABSTRACT

A piston for an internal combustion engine defining an axis of motion and including an annular cooling gallery defined within the piston. The cooling gallery extends annularly about the axis of motion of the piston. A plurality of annularly spaced fan blades is positioned within the cooling gallery. Each fan blade is oriented diagonally within the cooling gallery to direct a cooling fluid in an annular direction about the axis of motion of the piston.

23 Claims, 5 Drawing Sheets

COOLING GALLERY FAN ASSEMBLY FOR A PISTON

TECHNICAL FIELD

This invention relates generally to a piston for an internal combustion engine and more particularly to a piston having an internal cooling gallery with a structure inside the gallery to improve the flow and performance of a cooling fluid within the cooling gallery.

BACKGROUND

Those involved in the industry seek an efficient, lightweight, and compact internal combustion engine having increased horsepower. To achieve this it is necessary to push engine design toward its mechanical limits. Increasing combustion pressures in the combustion chamber requires higher combustion temperatures, faster piston speeds and increased mechanical forces. As a result, the piston and associated components are placed under greater mechanical stress.

In order to perform satisfactorily and survive in such an environment it is necessary to provide a piston that has improved cooling capabilities, increased strength, and a short compression height to reduce its mass. It is also important that such a piston is easy to manufacture with a high level of quality.

It is known to provide a piston with a closed piston cooling gallery. An example of this is shown in U.S. Pat. No. 4,581,983 to Moebus. The closed piston cooling gallery of Moebus is provided by welding a top portion of the piston to a bottom portion of the piston along a planar surface. The top and bottom portions of the piston each have a portion of the cooling gallery disposed therein. This piston has an excessively tall compression height making it heavy and unsuitable for high-speed operation. This piston is also difficult to manufacture and does not have the strength to withstand the increased stresses of the higher combustion pressures. The closed piston cooling gallery as configured in Moebus does not provide a height sufficient to permit adequate shaking of cooling fluid within the closed piston cooling gallery. Therefore, the efficiency of cooling of the piston is inadequate.

A method of increasing the contact between oil, or another cooling fluid, and the interior of the piston is by increasing the surface area of the interior of the piston, thereby providing more area for the oil to contact and from which it can absorb heat. U.S. Pat. No. 2,523,699 issued to Holt discloses a series of ribs projecting inwardly from the interior wall of the piston skirt. These ribs increase the heat dissipating area of the piston that is in contact with the oil as the oil is shaken by the reciprocating motion of the piston. However, although the ribs increase the surface area of the piston that may be in contact with the oil, the speed and direction of the oil within the gallery are based on the speed and orientation of the piston. Additionally, the intricate piston design set forth in Holt is very difficult to produce via forging or machining processes. Therefore, the piston disclosed in Holt is practical for use solely with cast pistons, and casting may introduce impurities into the cast product. These impurities can decrease the density of the product and thus decrease the product's resistance to deformation at high temperatures and pressures.

U.S. Pat. No. 6,532,913 to Opris shows a piston having an annular cooling fin extending from an upper inner surface of the piston. However, the continuous annular fin acts in a manner similar to that of Holt, that is, to dissipate heat by increasing the surface area on the inner surface of the piston. Although the fin increases the surface area of the piston to facilitate the dissipation of heat, as well as increasing the surface area of the piston that may be in contact with the oil, the speed and direction of the oil within the gallery will still be based on the speed and orientation of the piston. Therefore, as the piston moves in an axial direction, the majority of the oil will also be moving in the axial direction. The cooling fin has little or no impact on the movement of the oil while the fluid is within the oil gallery.

The present invention is directed to overcoming one or more of the problems set forth above.

SUMMARY OF THE INVENTION

In one aspect, a piston for an internal combustion engine is disclosed. The piston defines an axis of motion and includes an annular cooling gallery defined within the piston. The cooling gallery extends annularly about the axis of motion of the piston. A plurality of annularly spaced fan blades is positioned within the cooling gallery. Each fan blade is oriented diagonally within the cooling gallery to direct a cooling fluid in an annular direction about the axis of motion of the piston.

In another aspect, an internal combustion engine is disclosed. The engine includes a cylinder block having a cylinder bore defining an axis of motion for a piston slidably positioned in the bore. The piston has an interior surface defining an annular cooling gallery. The engine also includes a lubricating and cooling system for supplying a cooling fluid into the cooling gallery. A plurality of annularly spaced fan blades is positioned within the cooling gallery. Each fan blade is oriented diagonally within the cooling gallery to direct a cooling fluid in an annular direction about the axis of motion of the piston.

In another aspect, a method of making a piston is disclosed. The method includes the steps of providing a piston having an interior surface defining a substantially annular cooling gallery, providing a fan assembly having a plurality of fan blades, positioning the fan assembly within the cooling gallery, and attaching the fan assembly to the interior surface of the piston. The interior surface has an inboard wall, an outboard wall and an upper wall portion. The fan blades are annularly spaced within the cooling gallery, wherein each fan blade is oriented diagonally within the cooling gallery to direct a cooling fluid in an annular direction about the axis of motion of the piston.

DETAILED DESCRIPTION

Figure 1:
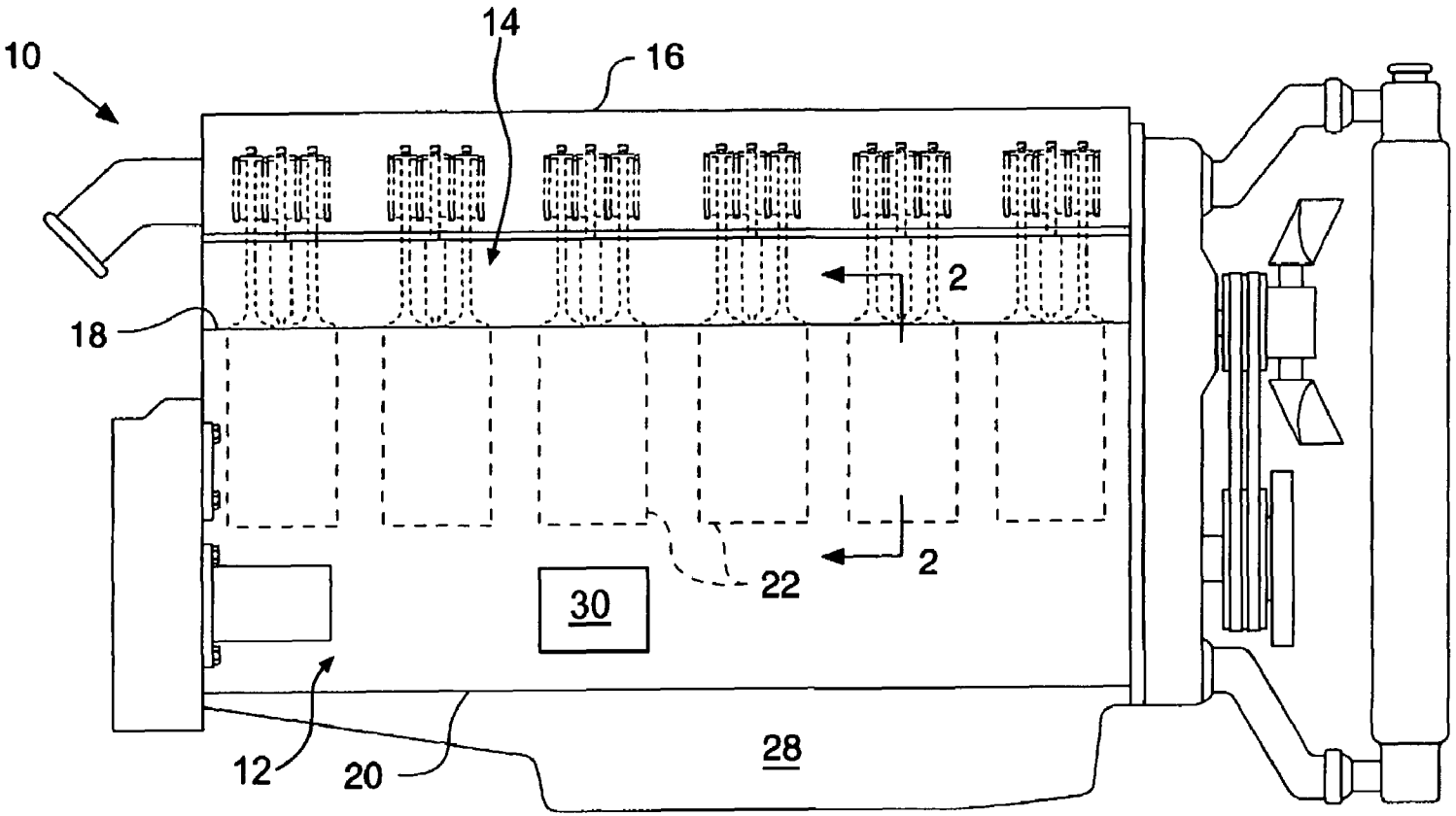
FIG. 1 is a side view of an engine.

Referring now to FIG. 1, a side view of an internal combustion engine 10 is shown. The engine 10 includes a cylinder block 12, a cylinder head 14 attached to the block 12, a valve cover 16 attached to the head 14, and a lubricating and cooling system (represented schematically and indicated generally at 30). These components are of a design that would be understood by one skilled in the art.

Figure 2:
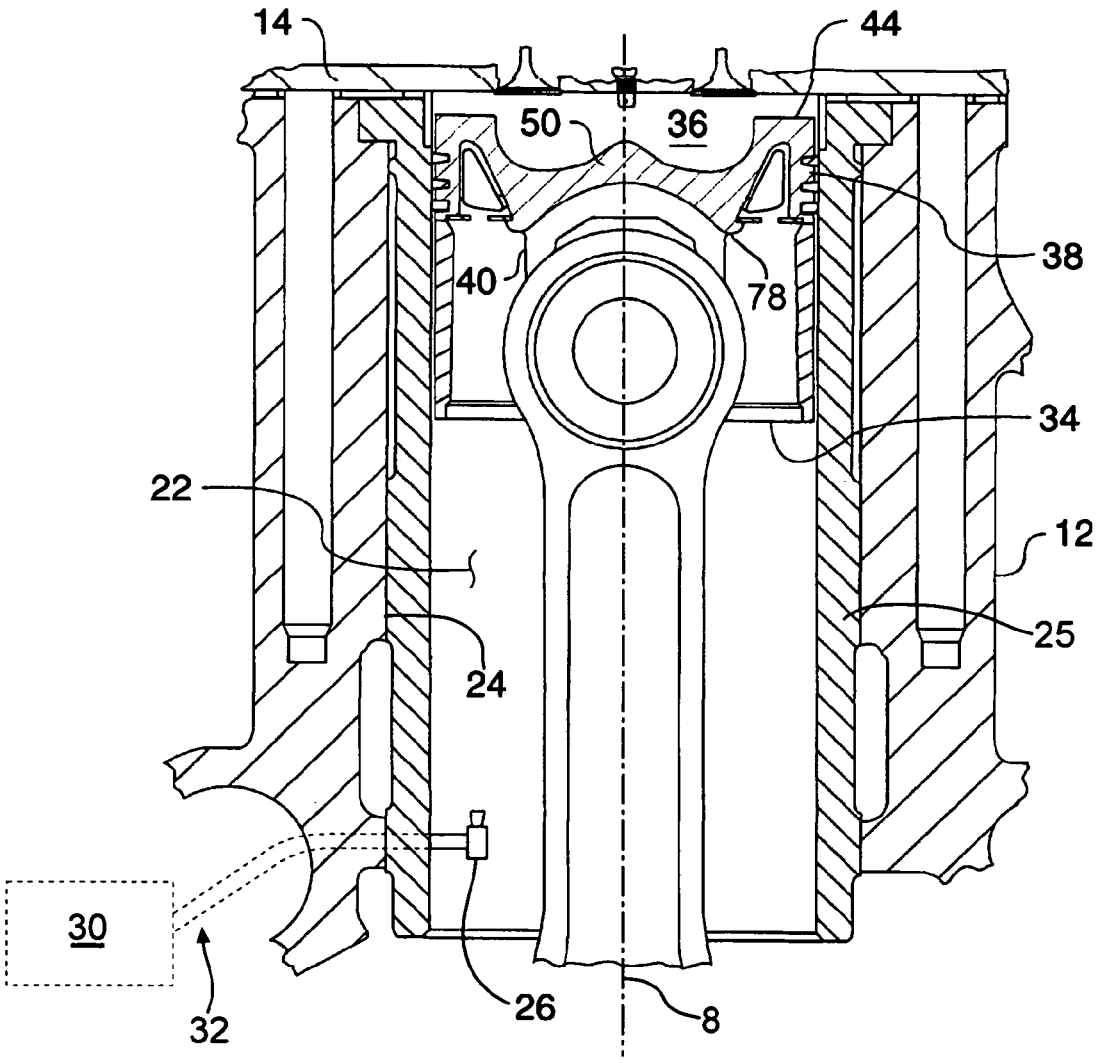
FIG. 2 is a cross-sectional view of a portion of the engine of FIG. 1 through Line 2-2.

The cylinder block 12 includes a top mounting surface 18, a bottom mounting surface 20, and a plurality of cylinder bores 22 located between the top mounting surface 18 and the bottom mounting surface 20. In the embodiment shown in FIG. 1, six cylinder bores 22 are equally spaced, in-line, and perpendicularly positioned with respect to the top mounting surface 18. However, the cylinder block 12 may be of any other design, such as "V" or radial, and may have any number of cylinder bores 22. As shown in FIG. 2, each cylinder bore 22 defines a cylinder wall 24 and an axis of motion 8 that is substantially parallel to the cylinder wall 24 and is also substantially concentric with the outer diameter of the cylinder bore 22. In the engine 10 shown in FIG. 2, a cylinder liner 25 is placed in the cylinder bore 22. However, the apparatus and method described in the present application may be used in engines that do not contain cylinder liners. The cylinder block 12 has a plurality of interconnected passages (represented schematically at 32) to enable the flow of a lubricating and/or cooling medium, such as oil (not shown) from the lubricating and cooling system 30. Secured to the cylinder block 12 and connected to the cooling passages 32 is a plurality of coolant directing nozzles 26 (only one of which is shown in FIG. 2). The cylinder block 12 also has an oil pan 28, shown in FIG. 1, connected to the cylinder block 12.

Also shown in FIG. 2 is a piston 34 that is slidably positioned within the cylinder bore 22 of the cylinder block 12. The piston 34 is a generally cylindrical structure having a top portion 38 and a pin portion 40. In FIG. 2, the piston 34 is shown as a one-piece piston. However, the piston 34 may be any conventional piston type, including an articulated piston or a composite piston. The piston 34 is configured to reciprocate along the axis of motion 8 described above. The piston 34, the cylinder wall 24, and the cylinder head 14 define a combustion zone 36.

Figure 3:
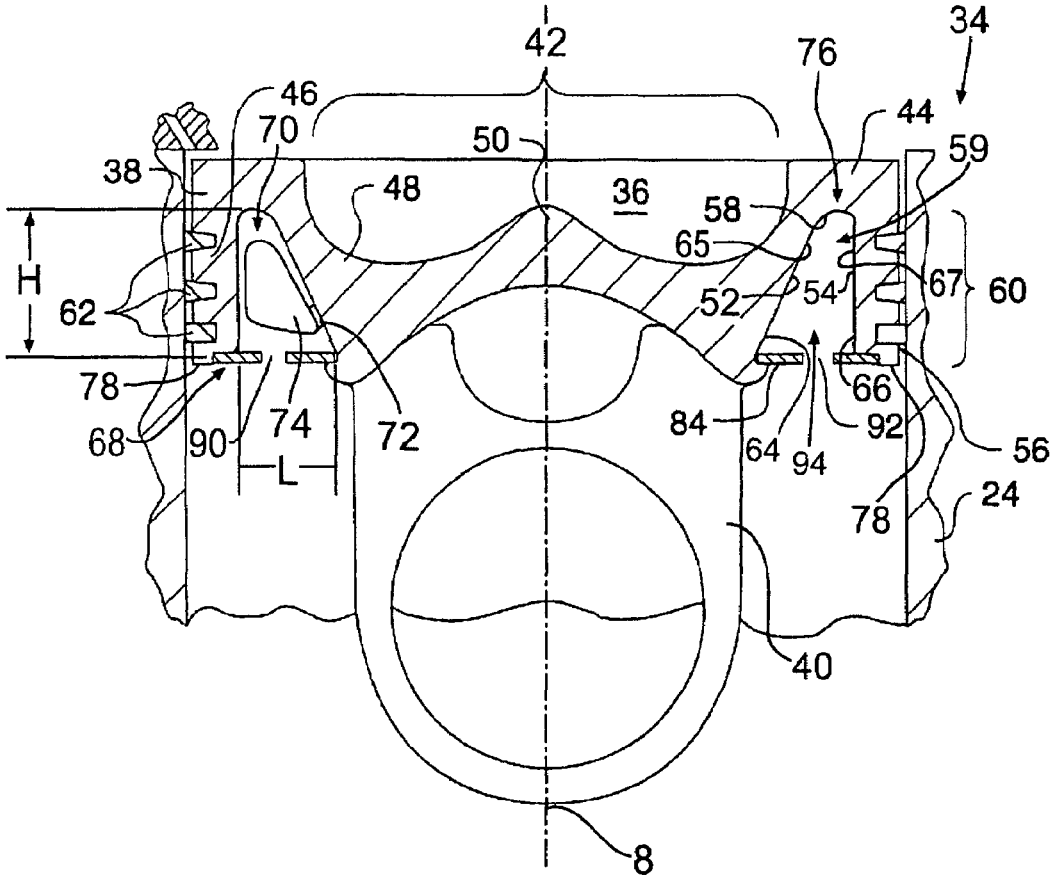
FIG. 3 is an enlarged view of a piston within the engine of FIG. 2.

Referring now to FIG. 3, an enlarged sectional view of the piston 34 is shown. The top portion 38 of the piston 34 is further defined by a bowl 42, a periphery portion 44, and an outer annular wall 46. An annular bowl portion 48 connected with the periphery portion 44 defines the bowl 42. The annular bowl portion 48 extends radially inward from the periphery portion 44 and connects to a conical section 50 forming an apex. In the piston 34 shown in FIG. 3, the periphery portion 44, the annular bowl portion 48, and the conical section 50 are integrally formed. As shown in FIG. 3, the distance from the apex of the conical section 50 to the cylinder head 14 is generally greater than the distance from the periphery portion 44 to the cylinder head 14. However, it should be appreciated that any suitable piston design can be used without departing from the scope of the present disclosure. As can also be seen in FIG. 3, the annular bowl portion 48 has an inner surface, hereinafter referenced as an inboard wall 52 of the interior surface 59 of the piston 34. The inboard wall 52 has a lower portion 64 and an upper portion 65.

In addition, FIG. 3 shows the periphery portion 44 extending radially away from the bowl 42 towards the cylinder wall 24. The outer annular wall 46 extends axially away from the periphery portion 44 towards the pin portion 40. The outer annular wall 46 has an inner surface and an outer surface 56. The outer surface 56 of the outer annular wall 46 has a sealing portion 60 in which any conventional manner of providing a seal between the piston 34 and the cylinder wall 24, such as a plurality of piston rings 62, can be formed. The inner surface is hereinafter referenced as an outboard wall 54 of the interior surface 59 of the piston 34. The outboard wall 54 has a lower portion 66 and an upper portion 67. The periphery portion 44 has an inner surface that is separated from the combustion zone 36. The inner surface of the periphery portion 44 is hereinafter referenced as the upper wall portion 58 of the interior surface 59 of the piston. The upper wall portion 58 is connected to, and integral with, the inboard wall 52 and the outboard wall 54. The upper wall portion 58, the inboard wall 52, and the outboard wall 54 substantially define the entire interior surface 59 of the piston 34.

In the embodiment of the piston 34 shown in FIG. 3, an annular cover plate 84 is connected to a lower surface 78 of the piston top portion 38. As shown, the cover plate 84 substantially covers and thereby defines a lower portion 68 of a cooling gallery 94. The cover plate 84 has at least one opening, and in the illustrated embodiments, has a receiving opening 90 and a draining opening 92 formed through the plate 84. A cover plate 84 having any number of openings can be used with any of the embodiments disclosed herein. The cover plate 84 and the interior surface 59 of the piston 34 substantially define the cooling gallery 94. Although the cooling gallery 94 is shown as being substantially annular, it can be appreciated that the cooling gallery could also be segmented, or divided into portions that do not extend substantially annularly about the axis of motion 8 of the piston 34. Similarly, the cover plate 84 could be annular, or could be made of a plurality of separate semi-annular cover plates. It should also be appreciated that although a cover plate 84 is shown in FIG. 3 as defining a lower portion 68 of the cooling gallery 94, a cover plate is not required in any of the embodiments shown and described herein. In particular, an embodiment having no cover plate is contemplated, as is an embodiment with a closed cooling gallery similar to that shown in Moebus (listed above). In such an embodiment, or any of the embodiments described herein, a piston could also be cross-drilled to facilitate the movement of a cooling fluid within the piston.

Figure 4:
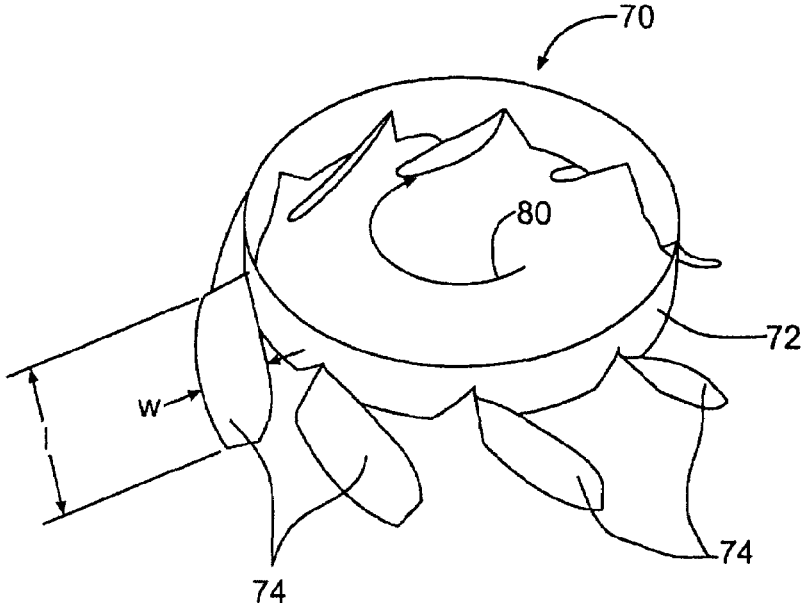
FIG. 4 is a perspective view of a fan assembly used with the piston shown in FIG. 3.

Also shown in FIG. 3 assembled within the piston 34, and shown separately in FIG. 4, is a fan assembly 70. In FIG. 3, for the purposes of clarity, the fan assembly 70 is only shown on one side of the cooling gallery 94. The fan assembly 70 is a structure including an annular band 72 and a plurality of fan blades 74 spaced around the annular band 72. In the illustrated embodiment, the fan blades 74 are integrally formed with the annular band 72. However, it can be appreciated that the fan blades 74 could be individually connected to the annular band 72. As can be seen, the fan blades 74 are oriented diagonally relative to the orientation of the annular band 72. The purpose of such a design will be described in greater detail below. The size and shape of the annular band 72 in the illustrated embodiment is such that the band 72 fits within the cooling gallery 94, and more particularly, so that the band 72 can be connected to the inboard wall 52 of the interior surface 59 (as shown in FIG. 3). As shown in FIGS. 2 and 3, the fan blades 74 then protrude towards the outboard wall 54 of the interior surface 59.

In FIG. 4, each of the fan blades 74 is shown having a width, w. In the assembled view shown in FIG. 3, it can be seen that the fan blades 74 extend across the width, L, of the cooling gallery 94. However, it can be appreciated that the width, w, of the fan blades 74 can be less than the width, L, of the cooling gallery 94 if it is so desired. Additionally, the fan blades 74 each have a length, l, which extends substantially from a lower portion 68 of the cooling gallery 94 to an upper portion 76 of the cooling gallery 94. Again, however, it can be appreciated that the length, l, of each fan blade 74 can be greater or less than the height, H of the cooling gallery 94. Particularly, the length, l, of a fan blade 74 could be more than the height, H, of the cooling gallery 94 if, for example, there were no cover plate 84 and the fan blade 74 extended below the lower surface 78 of the piston top portion 38. The annular band 72 and the fan blades 74 can also have any thickness. The thickness of the annular band 72 and the fan blades 74 can be based on any structural or mechanical requirements and as desired for a given application of this invention. Further, each fan blade 74 could also have a substantially planar fluid-directing surface, or a cupped, curved or arcuate fluid-directing surface.

The fan assembly 70 could be made using any suitable process such as casting, forging, stamping, or welding. Additionally, the fan assembly 70 can be made from any suitable material, such as steel, aluminum, titanium, composites, plastics, ceramics, metal-alloys, etc. However, it can be appreciated that the fan assembly 70 would be made from a material that can withstand the environment within the piston 34. For example, the fan assembly 70 should be configured to withstand the motion of the piston 34 and the temperatures experienced within the cooling gallery 94. That is, the fan assembly 70 should be able to tolerate the temperatures experienced by the piston 34, particularly those that are transferred to the cooling gallery 94 and to the cooling fluids that pass through the cooling gallery 94.

INDUSTRIAL APPLICABILITY

A cooling gallery, such as that indicated at 94, is generally known in the art. Cooling of the piston 34 is improved by injecting oil or other cooling fluids onto a lower surface 78 of the piston top portion 38 where the lower surface 78 is not subjected to a combustion environment. In the embodiment illustrated in FIG. 3, the cooling gallery 94 is formed within the piston 34. The cooling fluid is sprayed towards the receiving opening 90 in the cover plate 84 by the coolant directing nozzles 26 (shown in FIG. 2). The cooling fluid may exit the cooling gallery 94 through the draining opening 92, which is shown as being located opposite the location of the receiving opening 90. It should be appreciated, however, that any number of receiving openings 90 and draining openings 92 could be formed through the cover plate 84. During this operation, some cooling fluid will collect in the cooling gallery 94. As the collected cooling fluid moves in response to the reciprocating motion of the piston 34 along the axis of motion 8, heat from the piston 34 transfers into the cooling fluid and reduces the temperature of the piston 34.

In pistons that do not implement the present invention, the collected cooling fluid would move primarily along the axis of motion 8 of the piston. However, according to the embodiments disclosed herein, the cooling fluid within the cooling gallery 94 of the piston 34 is further directed by the fan blades 74 in an annular direction, as indicated by arrow 80 in FIG. 4, about the axis of motion 8 of the piston 34. Thus, the use of the fan blades 74 will increase the speed of the cooling fluid within the cooling gallery 94. An increase in the speed of the cooling fluid along the interior surface 59 of the piston 34 will allow more cooling fluid to contact more of the interior surface 59, and will thereby increase the overall heat rejection from the piston 34.

Although the fan blades 74 of the fan assembly 70 are shown as being angled in a first direction, it can be appreciated that the fan blades 74 could be oriented in a diagonal in the opposite direction, or in any other direction (such as angled towards the inboard wall 52 or the outboard wall 54). In addition, individual fan blades 74 could be oriented at different angles relative to each other if it were so desired. As is shown in FIG. 3, the annular band 72 is connected to a lower portion 66 of the inboard wall 52. It should be appreciated that the annular band 72 and the fan blades 74 can be configured to be connected to an upper portion 65 of the inboard wall 52 such that the fan blades 74 would "hang down" from the annular band 72.

In another embodiment of a fan assembly (not shown), the orientation of fan blades could be changed during the operation of the engine based on the speed, temperature or other operating conditions. Such a continuous reconfiguration of the fan blades during operation could be accomplished in a manner that is similar to the blades of a fan in a jet engine, with appropriate design changes in size and structure, as would be appreciated by one skilled in the art.

Figure 5:
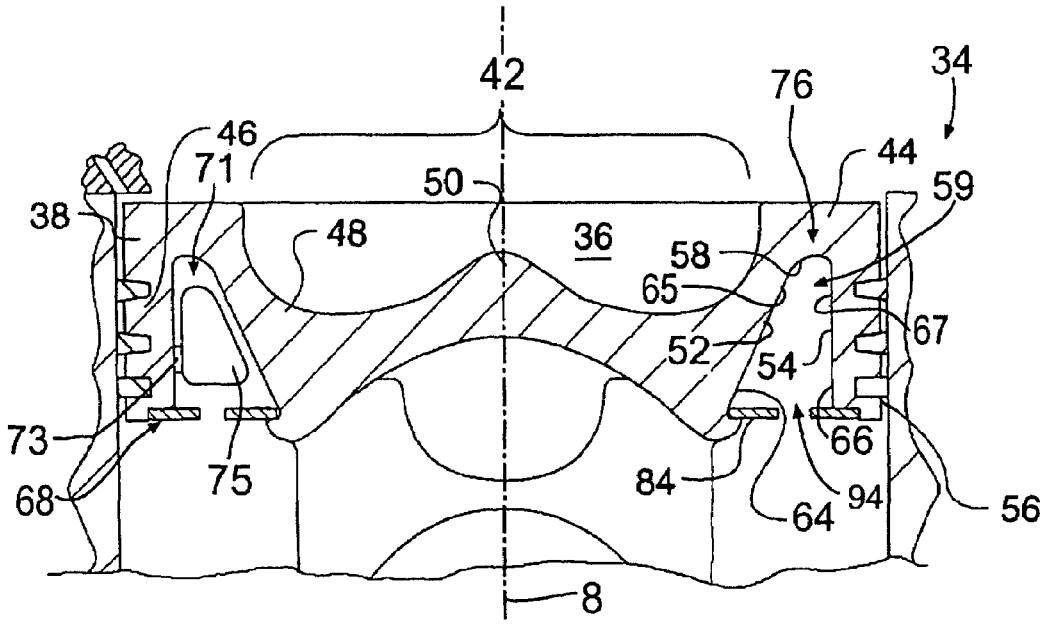
FIG. 5 is a cross-sectional view of a portion of an alternate embodiment of a piston.

In an alternate embodiment of the invention as illustrated in FIG. 5, an alternate embodiment of a fan assembly 71 is shown. The fan assembly 71 also includes an annular band 73 and a plurality of fan blades 75. The remaining portions of the piston 34 are substantially the same as the piston 34 shown and described above, therefore like parts have like reference numerals. The fan assembly 71 in this embodiment is inverted such that the size and shape of the annular band 73 is such that the band 73 fits within the cooling gallery 94, and more particularly, so that the band 73 is connected to the outboard wall 54 of the interior surface 59. In this embodiment, the fan blades 75 protrude towards the inboard wall 52 of the interior surface 59. The annular band 73 is configured to connect to an upper portion 67 or a lower portion 66 of the outboard wall 54.

It should also be appreciated that the annular band 72 can be connected to the interior surface 59 of the piston 34 in any suitable manner. For example, the annular band 72 could be press fit against the interior surface, or be welded to, fastened using any type of fastener, or threaded onto the interior surface 59 of the piston 34. Alternatively, the fan assembly 70 could be loosely positioned within the cooling gallery 94 and held within the cooling gallery 94 by the cover plate 84. The cover plate 84 could also be used with any of the other connecting mechanisms described herein, or otherwise as understood by one skilled in the art. It can also be appreciated that these methods of attachment apply to the embodiment of the fan assembly 71 shown in FIG. 5.

Figure 6:
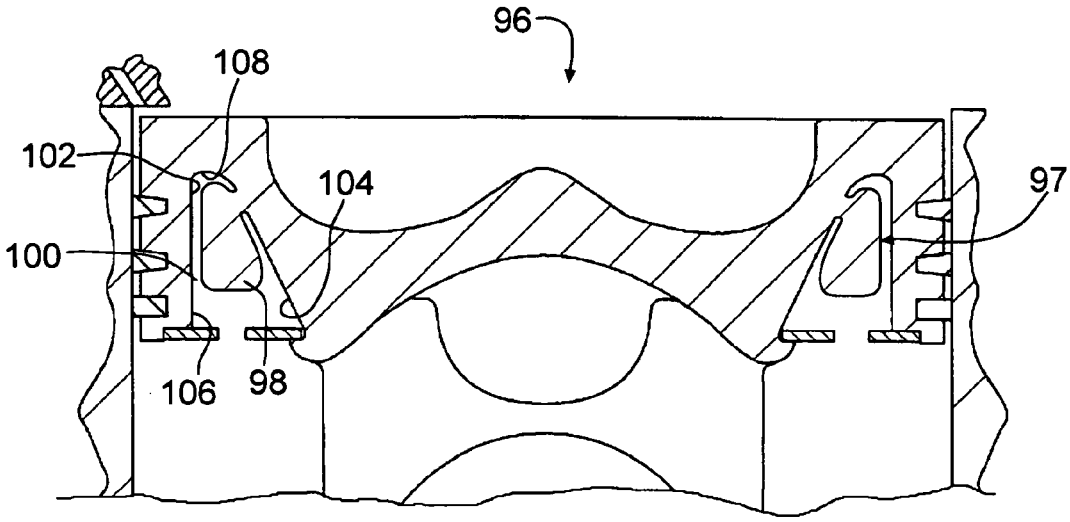
FIG. 6 is a cross-sectional view of a portion of an alternate embodiment of a piston.

Illustrated in FIG. 6 is an alternate embodiment of the invention showing a sectional view of a piston 96 with a fan assembly 97 having plurality of fan blades 98 positioned within a cooling gallery 100 within the piston 96. In this embodiment, the fan blades 98, oriented at a diagonal such that the fan assembly 97 can direct cooling fluid in an annular direction about the axis of motion 8 of the piston 96, are formed integrally with the interior surface 102 of the cooling gallery 100 of the piston 96. Alternatively, the fan blades 98 could be directly connected to the interior surface 102 of the cooling gallery 100. For example, the fan blades 98 could be forged inside the cooling gallery 100, machined into the cooling gallery 100 (for aluminum or steel pistons), cast into the cooling gallery 100 (for aluminum pistons), or welded to the interior surface 102 of the cooling gallery 100

(for aluminum or steel pistons). In any of these embodiments, the fan blades 98 are not supported on an annular band but extend directly from the interior surface 102 of the piston 96. Alternatively, each fan blade 98 could be individually, or in a group, be connected to a partial band (not shown) that is connected to the interior surface 102 of the cooling gallery 100. As with the embodiments described above, the fan blades 98 could extend from either the inboard wall 104 (upper or lower portions), the outboard wall 106 (upper or lower portions), or upper portion 108 of the interior surface 102 of the piston 96.

Figure 7:
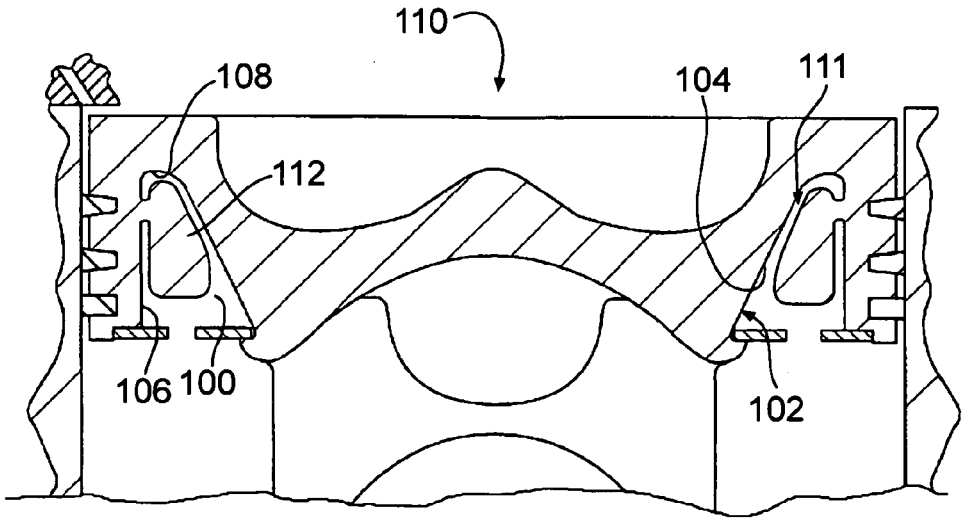
FIG. 7 is a cross-sectional view of a portion of an alternate embodiment of a piston.

In particular, illustrated in FIG. 7 is an alternate embodiment of the invention showing a sectional view of a piston 110 with a fan assembly 111 having plurality of fan blades 112 positioned within a cooling gallery 100 within the piston 110. The structure of the piston 110 is substantially the same as with the piston 96, except as described above. The remaining components have the same or similar structure are similarly numbered. In the illustrated embodiment, the fan blades 112 are directly connected to the interior surface 102 of the cooling gallery 100. As shown, the fan blades 112 extend directly from the interior surface 102 of the piston 110. It can be appreciated that the forming or attaching mechanisms can be the same as those described above with respect to the embodiment shown in FIG. 7.

With respect to any of the embodiments shown and described above, the precise location, dimensions, and orientation of the fan assembly, and more particularly of the fan blades, would be determined by examining various factors. Referring to the embodiment illustrated in FIGS. 1-4, one factor in the positioning of the fan assembly 70 is the location in the piston 34 from which heat needs to be dissipated. For example, if the temperature of the annular bowl portion 48 of the piston 34 needs to be reduced, the size and orientation of the fan blades 74 may be selected to ensure that the cooling fluid will contact the area of the annular bowl portion 48 that will effect the proper heat reduction. Another factor affecting the dimensions and orientation of the fan blades 74 is the magnitude of the heat that is to be evacuated from the piston 34. A fan blade 74 with a larger surface area can draw more heat from the piston 34. In addition, a thin fan blade 74 can dissipate more heat than a thick one. The amount of stress placed upon the piston 34 by the introduction of the fan assembly 70 and fan blades 74 is another factor that influences the location and dimensions thereof. The physical dimensions of the piston 34 also affect the size, location and orientation of the fan assembly 70 and fan blades 74. If the piston 34 contains the cover plate 84, the optimal dimensions of the fan assembly 70, and fan blades 74 will depend upon the size of the enclosed cooling gallery 94. The size of the fan blades 74 and the angle (and distance) at which they protrude from the interior surface 59 may be modified to ensure that the fan assembly 70 and fan blades 74 do not excessively impede the flow of the cooling fluid to other portions of the interior surface 59 and thereby detrimentally affect the cooling of the piston 34.

The addition of the fan assembly 70 to the interior surface 59 of the piston 34 effects heat attenuation of the portions of the piston 34 that are subject to the highest temperatures and pressures. A cooling fluid, such as oil, flows through the cooling passages 32 of the engine 10. The coolant-directing nozzle 26 sprays the cooling fluid onto the interior surface 59 of the piston 34. If the piston 34 has the cover plate 84, the cooling fluid enters the cooling gallery 94 through the receiving opening 90 and contacts the interior surface 59 and the fan assembly 70. The cooling fluid absorbs heat from the interior surface 59 and the fan assembly 70. This absorption of heat is greater than that in a piston 34 without the fan assembly 70 because the assembly increases the surface area for the cooling fluid to contact the piston 34. In addition, the position of the fan assembly 70 in the cooling gallery 94 allows the fan assembly 70 to draw heat from, and direct fluid to, a specific area of the piston 34. The cover plate 84 retains the cooling fluid in the cooling gallery 94, causing the cooling fluid to absorb more heat from the interior surface 59 as the fluid is repeatedly brought into contact with the fan assembly 70 and the interior surface 59 by the reciprocating motion of the piston 34. As stated above, the angled fan blades 74, 98 will increase the speed of the cooling fluid within the cooling gallery 94 by directing the fluid around the annular cooling gallery 94. An increase in the speed of the cooling fluid along the interior surface 59 of the piston 34 will allow more cooling fluid to contact the interior surface 59, and will thereby increase the overall heat rejection from the piston 34. The cooling fluid exits the cooling gallery 94 through the draining opening 92. After exiting the cooling gallery 94, the cooling fluid enters the oil pan 28 and is recirculated through the engine 10 and cooled by the engine cooling system 30 in any suitable manner.

If the piston 34 does not include the cover plate 84, the cooling fluid is simply sprayed directly onto the interior surface 59 and the fan assembly 70. The cooling fluid then absorbs heat from the interior surface 59 and the fan blades 74, 98. Due to the angled orientation of the fan blades, the fluid could potentially be retained within the cooling gallery 94 for a longer period of time before falling back into the oil pan 28. Thus, greater heat rejection from the piston 34 will be achieved without the additional structure of the cover plate 84. The cooling fluid is then recirculated through the engine 10 and cooled by the engine cooling system in the conventional manner. It should be appreciated that although the above-described operation of the fan assembly 70 has been described with respect to the embodiments shown in FIGS. 1-4, the operation of the embodiments shown in the remaining Figures is substantially similar.

The apparatus and method of the invention according to the embodiments shown and described herein, as well as their equivalents, may be used in any type of piston, including cast, forged, composite, and mechanically joined. The adjustable dimensions and location of the apparatus permit the specific targeting of areas in the piston from which heat is to be removed. Other aspects, objects, and advantages of this invention can be obtained from a study of the drawings, the disclosure, and the appended claims.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A piston for an internal combustion engine defining an axis of motion, the piston comprising:

a cooling gallery defined within the piston, the cooling gallery extending substantially annularly about the axis of motion of the piston; and a plurality of non-rotatable annularly spaced fan blades positioned within the cooling gallery;

wherein each fan blade is oriented diagonally within the cooling gallery to direct a cooling fluid in an annular direction about the axis of motion of the piston.

2. The piston defined in claim 1 wherein the plurality of fan blades are each supported on an annular band, the annular band being sized and shaped to fit within the cooling gallery.

3. The piston defined in claim 2 wherein the fan blades are integrally formed on the annular band.

4. The piston defined in claim 3 wherein the annular band is press fit against one of an inboard wall and an outboard wall of the cooling gallery.

5. The piston defined in claim 4 wherein the annular band is additionally held in place by a cover plate.

6. The piston defined in claim 3 wherein the annular band is attached to a wall of the cooling gallery by one of welding, threading, or fastening.

7. The piston defined in claim 1 wherein each fan blade extends directly from one of an inboard wall and an outboard wall of the cooling gallery.

8. The piston defined in claim 1 wherein the fan blade has a substantially planar fluid-directing surface.

9. The piston defined in claim 1 wherein the fan blade has an arcuate fluid-directing surface.

10. The piston defined in claim 1 wherein each fan blade has a width that extends substantially across the width of the cooling gallery.

11. The piston defined in claim 1 wherein each fan blade has a length that extends substantially from a lower portion of the cooling gallery to an upper portion of the cooling gallery.

12. The piston defined in claim 1 further including an annular cover plate substantially covering a lower portion of the cooling gallery, the cover plate having at least one opening formed through the cover plate.

13. An internal combustion engine comprising:

a cylinder block having a cylinder bore defining an axis of motion;

a piston slidably positioned in the cylinder bore, the piston having an interior surface defining a substantially annular cooling gallery, and being movable along the axis of motion;

a lubricating and cooling system for supplying a cooling fluid into the cooling gallery; and a plurality of annularly spaced fan blades positioned within the cooling gallery, wherein:

each fan blade is oriented diagonally within the cooling gallery to direct the cooling fluid in an annular direction about the axis of motion of the piston; and each fan blade has a width that extends substantially across the width of the cooling gallery.

14. The internal combustion engine defined in claim 13 wherein the plurality of fan blades are each supported on an annular band, wherein the annular band is connected to one of an inboard wall and an outboard wall of the interior surface of the piston.

15. The internal combustion engine defined in claim 14 wherein the annular band is press fit against one of the inboard wall and the outboard wall of the interior surface of the piston.

16. The internal combustion engine defined in claim 15 wherein the annular band is additionally held in place by a cover plate.

17. The internal combustion engine defined in claim 13 wherein the fan blades extend directly from one of an inboard wall and an outboard wall of the interior surface of the piston.

18. The internal combustion engine defined in claim 13 including an annular cover plate positioned over a lower portion of the cooling gallery, the cover plate having at least one opening formed through the cover plate;

wherein the cover plate and the interior surface of the piston further define the cooling gallery.

19. The internal combustion engine defined in claim 13 wherein each fan blade has a substantially planar fluid-directing surface.

20. The internal combustion engine defined in claim 13 wherein the fan blade has an arcuate fluid-directing surface.

21. A method of making a piston, the method comprising:

providing a piston having an interior surface, the interior surface having an inboard wall, an outboard wall and an upper wall portion, the interior surface further defining a substantially annular cooling gallery;

providing a non-rotatable fan assembly having a plurality of fan blades that are annularly spaced within the cooling gallery, wherein each fan blade is oriented diagonally within the cooling gallery to direct a cooling fluid in an annular direction about an axis of motion of the piston;

positioning the fan assembly within the cooling gallery; and attaching the fan assembly to the interior surface of the piston.

22. The method defined in claim 21 wherein the step of attaching the fan assembly to the interior surface includes one of press fitting, welding, threading or fastening.

23. The method defined in claim 21 including the step of attaching a cover plate positioned over a lower portion of the cooling gallery, the cover plate having at least one opening formed through the cover plate;

wherein the cover plate and the interior surface of the piston define the cooling gallery within the piston.

* * * * *